US007290961B1

(12) United States Patent
Ottman et al.

(10) Patent No.: US 7,290,961 B1
(45) Date of Patent: Nov. 6, 2007

(54) LIGHTWEIGHT TRENCH SHIELD

(76) Inventors: Michael H. Ottman, 5111 Silver Bullet Dr., Fort Mohave, AZ (US) 86426; James W. McLellan, 11820 S. Ki Rd., Phoenix, AZ (US) 85044

( * ) Notice: Subject to any disclaimer, the term of this patent is extended or adjusted under 35 U.S.C. 154(b) by 0 days.

(21) Appl. No.: 11/010,611

(22) Filed: Dec. 13, 2004

(51) Int. Cl.
*E02D 5/00* (2006.01)
*E21D 5/00* (2006.01)

(52) U.S. Cl. ..... 405/282; 405/272

(58) Field of Classification Search ..... 405/272, 405/282, 283
See application file for complete search history.

(56) References Cited

U.S. PATENT DOCUMENTS 3,561,177 A * 2/1971 Agro et al. ..... 52/169.14
4,259,028 A * 3/1981 Cook ..... 405/282
4,641,468 A * 2/1987 Slater ..... 52/309.4
4,983,076 A * 1/1991 Vidal ..... 405/284
5,305,568 A 4/1994 Beckerman ..... 52/309.4
5,310,290 A 5/1994 Spencer ..... 405/283
5,503,504 A * 4/1996 Hess et al. ..... 405/282
5,549,418 A * 8/1996 Devine et al. ..... 405/258.1
5,741,091 A * 4/1998 St. George et al. ..... 405/283

* cited by examiner

*Primary Examiner*—Tara L. Mayo
(74) *Attorney, Agent, or Firm*—Gregory J. Nelson

(57) ABSTRACT

A lightweight trench shield having side panels spaced apart by spreaders. Each panel has a core formed of a metal honeycomb with the core faces having a fiber in resin matrix layer thereon. The core density varies with regions proximate the spreader supports being increased to provide support for side loads. The spreader supports receive the ends of the spreaders and distribute the applied loads outwardly from the spreader via a mounting ring.

6 Claims, 2 Drawing Sheets

LIGHTWEIGHT TRENCH SHIELD

BACKGROUND OF THE INVENTION

This invention relates to a trench shield used for the protection of workers operating in excavations. In particular, the present invention is directed to the provision of a lightweight trench shield capable of providing the necessary protection to a trench worker while being capable of movement by a single worker along an excavation without the use of mechanical equipment.

A trench shield is a protective structure that is intended to protect workers as they conduct operations below the ground surface, for example laying pipe and running footings for structures. The trench is typically of significant length to require the movement of the shield therealong as the work site advances. In the case of trench shields utilizing steel face plates with spreaders therebetween, the weight of the shield has required the use of equipment, such as a backhoe, to advance the shield along the trench. The need for equipment coupled with the additional manpower has generated interest in the development of trench shields that possess a high strength to weight ratio and satisfy the governmental regulations specifying loading capability.

Trench shields utilizing different materials for the adjacently spaced side panels have been proposed. Examples include the use of corrugated metal panels, molded composite lightweight panels and lightweight wood blocks oriented to utilize the directional strength properties of wood. These proposed shields have not found acceptance either due to cost of manufacture, lack of durability and inability to withstand prescribed loading requirements.

Accordingly, the present invention is directed to a lightweight trench shield that has a strength to weight ratio that enables a worker to advance the shield along the trench without assistance. Further, the subject trench shield utilizes spreader supports which distribute the loading on the spaced panels outwardly thereby enhancing load bearing capability. The side panels are constructed with regions proximate to the spreader supports capable of withstanding greater loading than other regions of the panel. Thus, the present trench shield is capable of providing protection while possessing the capability of being moved by a single worker along the trench.

SUMMARY OF THE INVENTION

The present invention is directed to a lightweight trench shield of the type having two adjacently spaced side panels with spreaders located therebetween to maintain the spacing, provide stability and to offer protection to a worker positioned between the side panels. The trench shield is advanced along the trench by the worker as work is performed on cables, wires, pipes and the like residing in the trench. In order for the worker to move the shield without assistance, the shield is required to be light in weight, stable and have load-bearing capability should the trench wall collapse.

To that end, the invention utilizes a pair of side panels, each having a core with a peripheral region extending therearound. The core is fabricated of honeycomb material with the voids extending between the large area core faces of the panels. Stabilization means, typically in the form of a fiber-resin matrix, is bonded to the core faces to provide stability to the honeycomb.

The side panel spacing is maintained by a plurality of spreaders extending between spreader supports affixed to the inner faces of the side panels. The spreaders are typically tubes dimensioned to be removably received in the supports. Substitution of the spreaders permits the width dimensions of the trench shield to be changed in accordance with the trench width and workspace required for the task being performed.

A spreader support includes a central socket for receiving the spreader. The socket is supported by a loading ring which is outwardly located from the socket and positions the socket away from the side panel. The spacing of the socket from the surface of the panel results in a distribution of the load on the side panel via the loading ring to the socket and the spreader therein.

The density of the honeycomb material forming the core of the side panel is non-uniform across the panel. The density is increased in the regions proximate to the locations of the spreader supports to enhance the load-bearing capability of the side panel. The weight of a side panel having a prescribed load-bearing capability is decreased. As a result, the ability of a workman to move the trench shield along the trench without assistance is enhanced.

Further features and advantages of the invention will become more readily apparent from the following description when taken in conjunction with the accompanying drawings.

BRIEF DESCRIPTION OF THE DRAWINGS

Referring now to FIG. 1, a trench shield 11 constructed in accordance with the present invention is shown positioned at the bottom of a trench 10. The typical trench has a depth of about eight feet. The length is determined by the task requirements. The shield as shown in FIG. 1 has a pair of side panels 12 which are eight feet by six feet with chamfered corners to assist in rolling along the bottom surface of the trench. Alternatively, the worker can simply drag the shield if the bottom surface conditions permit.

Figure 1:
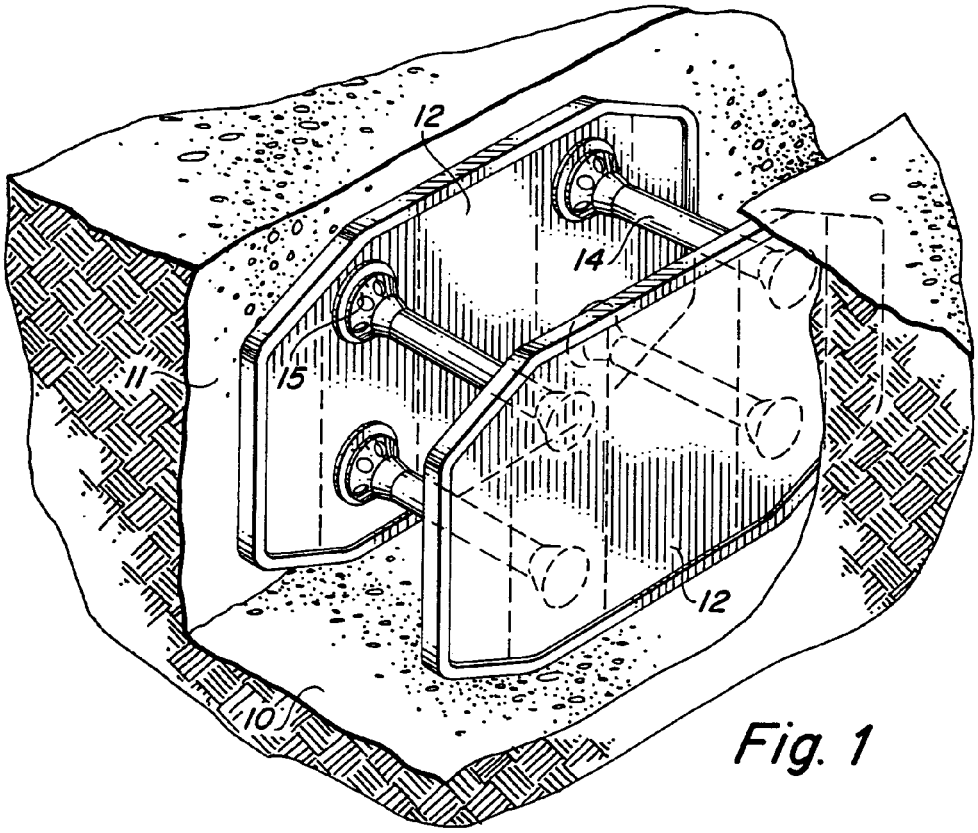
FIG. 1 is a view in perspective showing a preferred embodiment of the invention.
Figure 2:
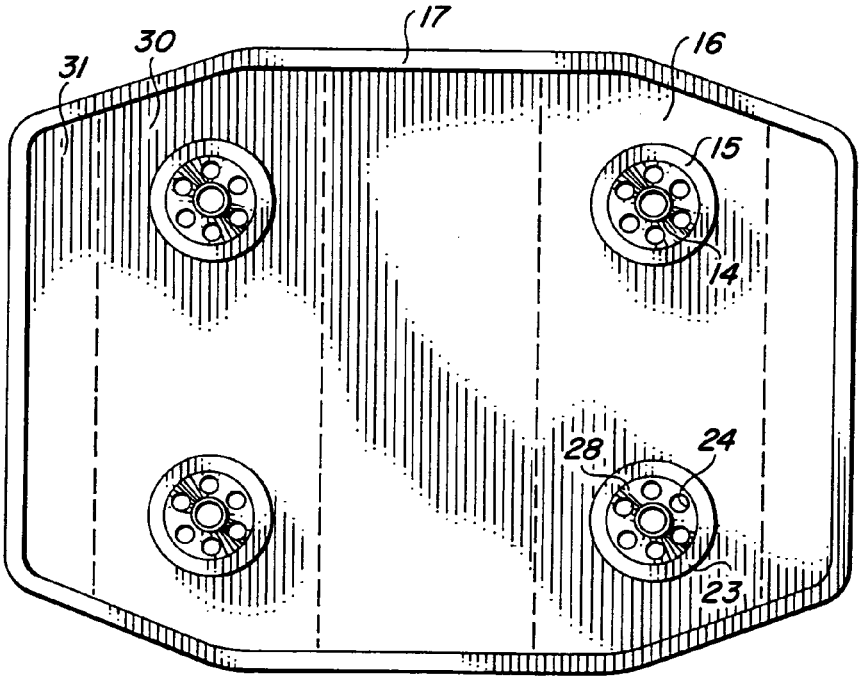
FIG. 2 is a side view of the embodiment of FIG. 1.

The side panels 12 are connected by four tubular spreaders 14 spaced to form a rectangle of support for each panel. Each side panel has four spreader supports 15 located as shown in FIGS. 1 and 2. A spreader support contains a central socket which removably receives the end of a spreader. Spreader length is usually within the range of three feet to four feet although different lengths can be used for different work projects. A side panel 14 includes a core of honeycomb metal, typically aluminum, which provides lateral strength to the side panel in the event that the trench wall material sloughs off the wall face or the wall collapses. The use of a honeycomb metal core substantially reduces the overall weight of the side panel while providing good protection to a worker positioned between the pair of side panels. To aid in maintaining the shape of the panels 12 and to prevent the adjacent soil from entering the voids of the honeycomb core, protective stabilization layers 16 are applied to the outer surfaces of the panels 12. The stabilization layer is formed of fibers embedded in an epoxy matrix. Typically, the fibers are carbon which provides a stabilization layer having a higher strength to weight ration than metal face sheets. The fiber in resin matrix layer is applied in the form of a thin sheet typically within the range of 0.018 to 0.030 inches to both sides of the honeycomb metal core. The fiber volume fraction is about 60 to 65 percent.

The present method of securing the thin sheet to the core includes the placement of the sheets on both faces of the core with the transfer sheet facing outward. The assemblage is wrapped with plastic and a reduced pressure is maintained while the temperature is elevated. For example, a core having 0.030 inch carbon fiber-epoxy matrix sheets applied thereto is heated to 250 degrees F. for two hours. The wrapping and transfer sheets are removed leaving a thin stabilization layer across the faces of the panel. The layer is bonded to the core. The layer carries the bending stresses in the side panels. The underlying honeycomb core reduces the tendency of a layer to buckle. The honeycomb core provides substantially uniform support to the stabilization layer across the core face in contrast to the use of beams and ribs to form a side panel.

Figure 3:
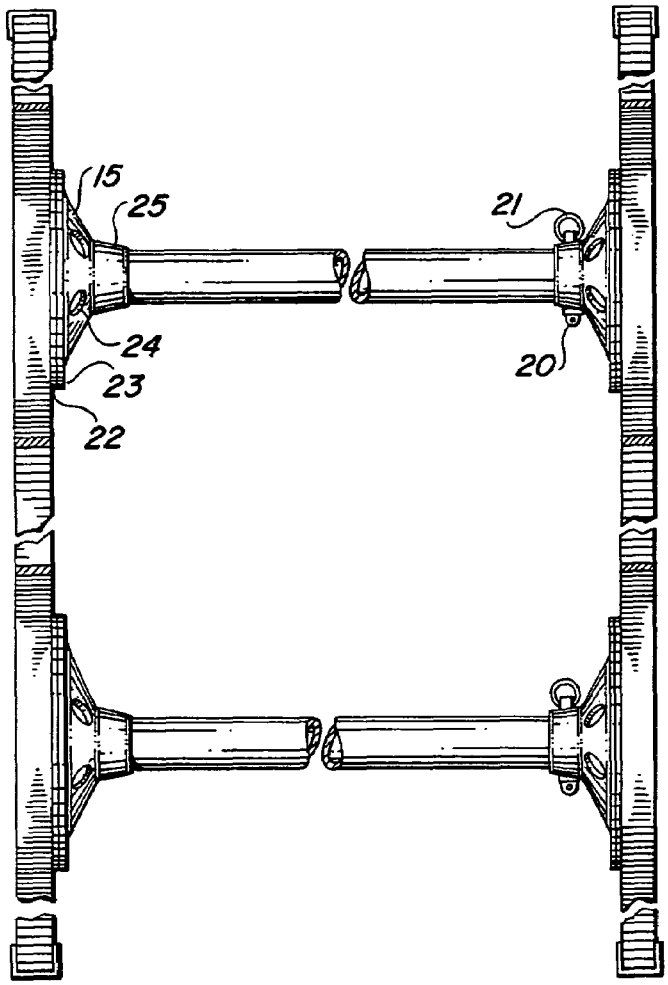
FIG. 3 is an end view of the embodiment of FIG. 1.
Figure 4:
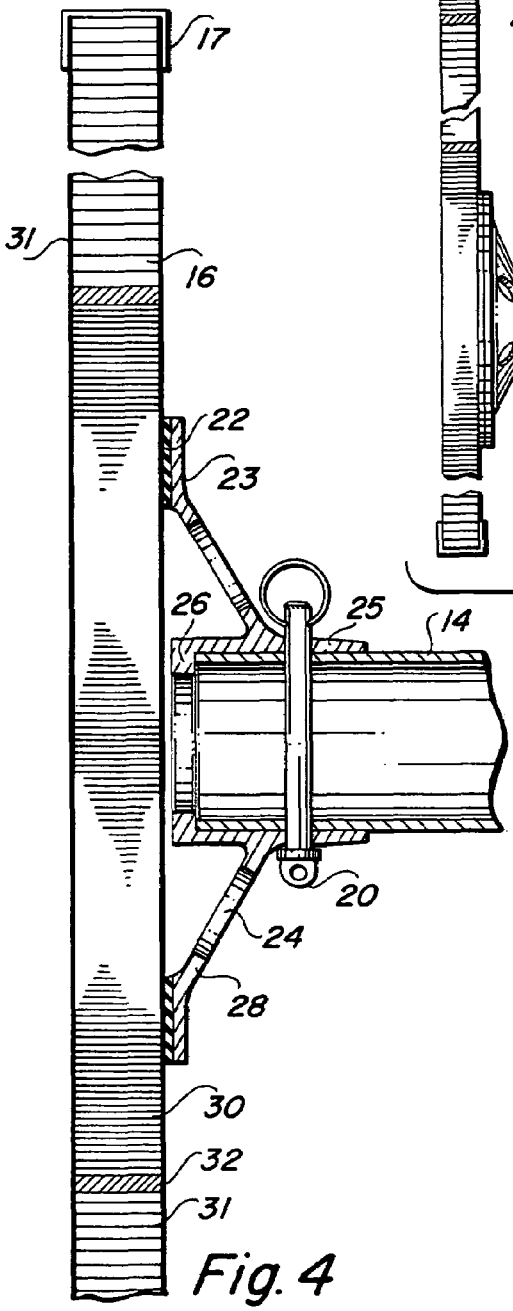
FIG. 4 is a view in partial section showing a spreader support of the embodiment of FIG. 1.

The side panels 12 are provided with edge protection members 17 which are affixed to the peripheral region of each panel. In operation, the trench shield is dragged or rolled along the trench floor. As a result, both protection of exposed edges of the honeycomb core with the stabilization layer thereon and the provision of a smooth edge for ease of movement are provided as shown in FIGS. 3 and 4. The edge protection member 17 is an aluminum c-channel that is bonded to the peripheral region of the side panel by epoxy. The epoxy is applied to the edge adjacent portion of the stabilization layer 16 and the c-channel member is placed on the edge.

The spreader supports 15 shown in FIGS. 3 and 4 are formed of cast aluminum for weight reduction. In addition, openings 24 are formed in the web region 28 between the centrally-located socket 25 and the loading ring to reduce weight. The side panels each have four spaced spreader supports on the inside facing. The spreader support 15 is bonded to a rubber load distribution pad 22 that is bonded to the surface protective layer 16. The pad has been formed of Buna-N or Nitrile rubber and bonded to layer 16 by epoxy. The pad is used to distribute a load from the spreader more evenly over the face of the layer by accommodating irregularities of a cast surface and avoid the step of machining the surface of the casting. If the additional manufacturing step is performed, the load distribution pad may be omitted from the side panel. However, the web region 28 is then extended to provide a spacing between socket 25 and the side panel. The spreader support 15 includes a central socket 25 for receiving spreader 14 therein. The socket terminates in an inwardly extending flange 26. The base of the socket is open for weight reduction. A web 28 containing a plurality of openings 24 extends outwardly and downwardly to a circumferential loading ring 23. The loading ring distributes the spreader load over a larger area than that of the socket to reduce the possibility that the honeycomb core might fail in compression. Also, the circumference of the loading ring is sufficiently large to avoid failure due to shear forces in the core.

In the embodiment shown in FIGS. 3 and 4, the central socket has 4.0 inches as the internal diameter and the radial width of the loading ring is 4.0 inches. The outer diameter of the ring is 14.5 inches. Thus, the forces from the spreader loads are distributed over a large area thereby aiding in increasing the strength to weight ratio of the device, In addition, the web 28 supports the central socket 25 and terminal flange 26 above the surface of the side panel as shown in FIG. 4. The spacing enables impact loads form the spreader to be distributed by the loading ring rather than to deform the spreader socket or cause damage to the adjacent portion of the core.

The spreader socket 25 is provided with diametrically opposed holes to receive locking pin 20. Mating holes are located in the tubular spreaders 14. A retaining clip 21 is placed in the inserted end of pin 20 to secure the spreader in the socket. The spreader sockets are typically positioned on the inner faces of the opposing side panels in general vertical and horizontal alignment to provide a workplace therebetween when the long dimension contacts the trench bottom. The placement and number of the spreader supports can be modified if desired for a particular application.

Figure 5:
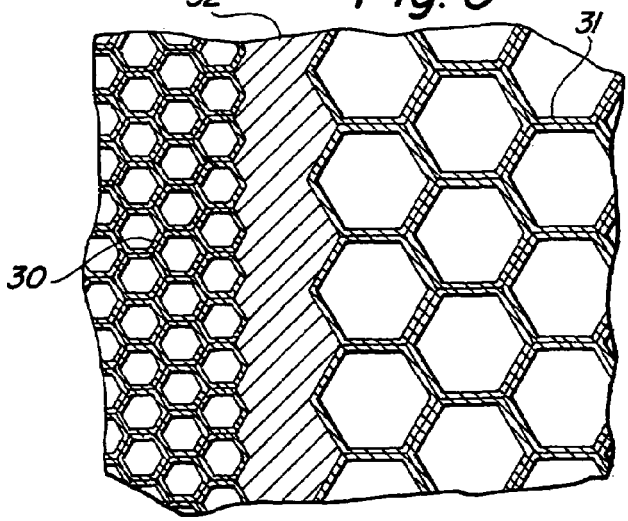
FIG. 5 is a view in partial section showing the interface between core sections of different density.

To further improve the strength-weight ratio of the subject invention, the density of the metal honeycomb is not constant throughout the side panels. The regions underlying the spreader supports 15 have an increased density, that is, the dimensions of the cells of the honeycomb are smaller than the dimensions of the honeycomb cells remote from the spreader supports. In FIGS. 4 and 5, the partial cross-sectional views show the transition from the high density hexagonal cells 30 to the low density cells 32.

In the embodiment shown, the side panels were made of aluminum honeycomb cores with densities of 8.1 lb/ft3 and 4.5 lb/ft3. The core thickness is 1.9 inches. The joining of high density and low density regions is accomplished using a syntactic foam tape placed on the edges to be joined. After aligning the edges side-by-side, the assemblage is heated and the foam expands into adjacent voids forming a bond as shown by the adhesive layer 32. Alternatively, a thixotropic epoxy mixture can be applied to the adjacent honeycombed edges.

The variation in core density across the long dimension of the side panel is shown in FIG. 2 wherein the dashed lines are used to designate the transitions in core density. The side panel in the preferred embodiment is comprised of two regions 30 of high density honeycomb core and three regions 31 of low density core. The use of high density regions which extend between opposing edges of the side panel as shown in FIG. 2 provides a manufacturing cost advantage over the use of individual high density regions beneath each spreader support.

The above-described embodiment of the invention carries a weight of less than two hundred pounds for an 8 ft.×6 ft. trench shield that satisfies current safety recommendations for C-60 soil. The strength-weight ratio is determined in part by the size, thickness and the material used in the honeycomb core. Aluminum has been found to be the preferred material. While the foregoing description has referred to a specific embodiment of the invention, it is to be noted that modifications and variations may be made therein without departing from the scope of the invention as claimed.

We claim:

1. A trench shield comprising:

(a) first and second adjacently spaced side panels, each panel including a core having opposing core faces and a peripheral region extending therearound, said core being formed of a honeycomb material having areas of greater and lower density;

(b) non-metal stabilization means applied to each core face;

(c) edge protection members affixed to the peripheral region of each panel;

(d) a plurality of spreader sockets, said sockets being located on adjacent facing surfaces of the side panels proximate areas of greater core density, said sockets being rigidly affixed to supports extending outwardly from said sockets and terminating at a circumferential loading ring with an open space defined between said supports and the adjacent core face, said sockets projecting into said space having a terminal flange spaced from the adjacent core face to distribute loads;

(e) resilient pads interposed between said loading rings and said facing panel surfaces; and (f) a plurality of spreaders extending between said spreader sockets to determine the spacing between said side panels.

2. The trench shield of claim 1 wherein said stabilization means is a surface stabilization layer formed of fibers contained in an epoxy matrix, said layer covering the core faces of each panel.

3. The trench shield of claim 1 wherein said edge protection members are channel members located on the edge of each panel and affixed to the stabilization means.

4. The improvement of claim 1 wherein the core is formed having two spaced high density regions and a low density region therebetween.

5. The improvement of claim 1 wherein the core is formed having five regions extending thereacross with two spaced high density regions being bounded by three spaced low density regions.

6. The improvement of claim 1 wherein said core is constructed from metal honeycomb material.

* * * * *